United States Patent [19]

Kern

[11] 4,229,501

[45] Oct. 21, 1980

[54] STEEL RODS, ESPECIALLY REINFORCING OR TENSIONING RODS

[75] Inventor: Georg Kern, Munich, Fed. Rep. of Germany

[73] Assignee: Dyckerhoff & Widman Aktiengesellschaft, Munich, Fed. Rep. of Germany

[21] Appl. No.: 36,139

[22] Filed: May 4, 1979

[30] Foreign Application Priority Data

May 19, 1978 [DE] Fed. Rep. of Germany ..... 2821902

[51] Int. Cl.[2] ..... D02G 3/00; E04C 3/30

[52] U.S. Cl. ..... 428/399; 52/737; 52/740; 428/400

[58] Field of Search ..... 428/397, 400, 379, 592, 428/600, 606, 687, 399; 52/737, 740

[56] References Cited

U.S. PATENT DOCUMENTS

| | | | |
|---|---|---|---|
| 1,339,226 | 5/1920 | Schuster | 52/737 X |
| 3,561,185 | 2/1971 | Finsterwalder et al. | 52/737 |
| 3,979,186 | 9/1976 | Mizuma | 428/592 X |
| 4,137,686 | 2/1979 | Kern | 52/737 X |

*Primary Examiner*—Lorraine T. Kendell

*Attorney, Agent, or Firm*—Orville N. Greene; Frank L. Durr

[57] ABSTRACT

A steel rod of the type having a generally rounded core and two or more spaced series of parallel ribs projecting therefrom, so constructed that the ribs act as threads to attach the rod to an anchoring or connecting device which has matching internal threads, is provided which in addition to the rib structure has a longitudinal groove in at least one of the regions between the adjacent ends of two of the series of ribs. The longitudinal groove or grooves provides a canal which permits the cavities between the rod and an enveloping anchoring or connecting means to be filled with cement or similar material which will protect the internal surfaces against corrosion.

5 Claims, 4 Drawing Figures

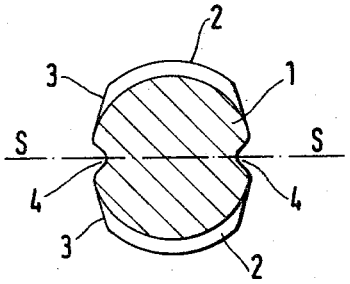
FIG. 1
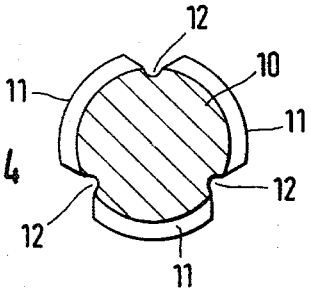
FIG. 4
FIG. 2
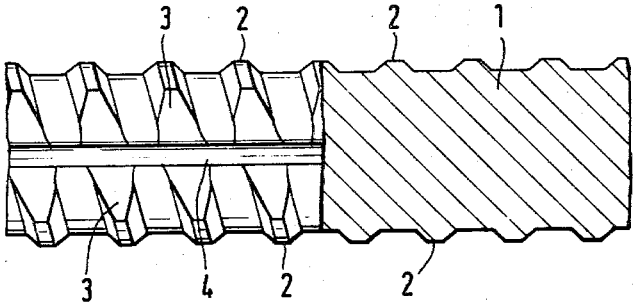
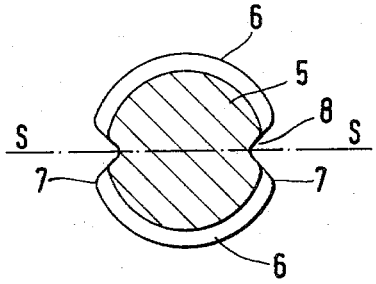
FIG. 3

STEEL RODS, ESPECIALLY REINFORCING OR TENSIONING RODS

The invention relates to steel rods, especially rods for reinforcing concrete or for tensioning or stressing concrete, which rods are formed with hot rolled, spirally aligned spaced ribs, forming sections of a screw thread and whose end view has the general appearance of a plain core cross-section.

Steel rods of this kind can be employed on the one hand, as loose or untensioned reinforcements for concrete because the ribs provide for good adhesion to the respective rods in the concrete. As a result of the screw-formed partial thread, such rods can also be finally stressed with help from screw-sleeves. The end plane of the ribs form surfaces which fit in concrete, through which the screwing-out of the rods from the concrete by stress is avoided.

On the other hand, such steel rods can also be employed as stress rods for reinforced concrete because from the spirally aligned spaced ribs which form a spiral thread, an anchoring body showing a corresponding counter-thread can be threaded thereon. The rib surface suffices for use as a tensioning rod in order to be able to transmit the tensioning force satisfactorily from the anchoring body.

Steel rods of this type are manufactured as a rule by a heat rolling process between two rolls, an upper and a lower roll. The advantage of this is that the partial spiral threads are provided along the entire length of the rods by the rolling process, so that no after-working is required for mounting or attaching the anchoring or connecting body; these bodies need only to be screwed on.

With rollers it is often difficult to synchronize the shape of the rollers to the dimensions of the rod cross-section with the ribs, so as to attain, in every case, a satisfactory form of rib and a flow of the dislocated materials in the ribs. Often the smooth rod surface between the end surfaces of the ribs is distorted, there is formed in the longitudinal direction of the rods a developed burr or lumpy ribs, which interrupts the screwing in of the anchoring or attaching body.

Since furthermore, the spiral threads formed on the rod by the ribs is only a partial thread, the threads on its anchoring or connecting body must be a fully-formed thread and since the tolerances of the hot rolled ribs are relatively large, cavities often exist in the interior of the anchoring or connecting body. Slack, non-stressed reinforcing rods are embedded in the concrete and become tension rods when they are stretched after the hardening of the concrete, having been introduced in jackets and the jackets being injected with mortar or adhesive cement after the tensioning of the rods so that in every case a safer corrosion protection of the steel parts against the concrete or cement mortar is obtained. The cavities in the interior of the anchoring or connecting body are, however, not protected because the cavity between the outer circumference of the rod and the entrance opening of the anchoring or connecting body is too small to allow the penetration of the adhesive cement.

The invention is based on the problem of making it possible to guarantee the corrosion protection of a steel rod at the outset.

According to the invention, these problems are solved by disposing continuous, longitudinal grooves between the ends of the ribs in the steel rods of the indicated kind.

The advantage of the construction of the rods of the invention consists first, that through the continuous depression in the zone between the ribs, openings are made between the surface of the steel rod and the intake joint of the anchoring and/or connecting means in such a way that the threadability of the threads and the utility of the rods as reinforcing rods or as tendons does not suffer in any way. Thus adhesive cement or injection material can penetrate through these openings as in a canal into the thin interstitial space within the anchoring and/or connecting body and this space filled up for corrosion protection. Thereby at the same time a variety of adhesion of the parts is attained.

If the depressions are made in a working operation prior to the rolling of the ribs, there is an advantage that the flowed material produced by the rolling of the ribs can turn aside at least in part in these grooves, which indeed can change their form somewhat without, however, influencing their function. In any case, the shape of the overflow or lengthwise rib is hindered safely.

Further advantages of the invention will be apparent from the claims below.

The invention will now be more precisely explained with the aid of an example of embodiments thereof illustrated in the drawing, wherein, FIG. 1 is a cross-sectional view and FIG. 2 is a side view partially cutaway of a steel rod made according to the invention.

FIGS. 3 and 4 are cross-sectional views of other modified forms of the invention.

The steel rod 1 is provided with two series of ribs on opposite sides, the two sides being symmetrically formed with reference to the plane S-S, which rod already had been produced with suitable grooves by rolling. The ribs 2 extend to their fullest height only over about one third of the circumference of the rod. They pass opposite the middle point of the plane S-S above the plane rod surface and are inclined down at their end surfaces 3 toward the symmetry plane.

In the region between the end surfaces 3 of the ribs 2 which in the present case lies in the symmetry plane S-S, continuous, rounded grooves or depressions 4 are provided in the longitudinal direction of the rods.

With that modification shown in FIG. 3, the steel rod 5 has ribs 6 extending over a greater extent of the circumference than in FIG. 1. The ends 7 of the ribs 6 shrink into the longitudinal, rounded, grooves 8. Thereby the rib surface normal to the thrust of the rod is significantly increased.

A further example is shown in FIG. 4. Here the steel rod 10 is provided with three series of ribs 11 which are displaced 120° with respect to one another. Accordingly the rod 10 is provided with three longitudinal grooves 12.

If an anchoring body or a threaded sleeve is screwed onto the steel rod of the invention, then blowholes are formed in the threaded ribs of these bodies, at the peripheral surface of the core profile of rod 1,5 or 10, while the grooves 4,8 or 10 form canals through which the adhesive cement can penetrate into the cavities between the rod 1 and the anchoring body.

I claim:

1. A steel rod of the type of a generally circular configuration comprising a core body, with at least two spaced longitudinal series or aligned ribs thereon extending beyond the core body which series together provide parts of a spiral winding of the core body, the improvement comprising at least one continuous longitudinal groove extending into the core body in a region between two of said series of spaced ribs.

2. The steel rod as claimed in claim 1 wherein the end portions of the ribs of said series level off to the core.

3. The steel rod as claimed in claim 1 wherein the end portions of the ribs round off into the longitudinally extending groove.

4. The steel rod as claimed in claim 1 wherein the rods have at least three longitudinal series of spaced aligned ribs.

5. The steel rod as claimed in claims 1–4 wherein the edges of said groove at the periphery of the core body are rounded.

* * * * *